US007124839B2

(12) United States Patent
Furuta et al.

(10) Patent No.: US 7,124,839 B2
(45) **Date of Patent: *Oct. 24, 2006**

(54) IMPACT DRIVER HAVING AN EXTERNAL MECHANISM WHICH OPERATION MODE CAN BE SELECTIVELY SWITCHED BETWEEN IMPACT AND DRILL MODES

(75) Inventors: Takefumi Furuta, Anjo (JP); Yoshihiro Ito, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/070,161

(22) Filed: Mar. 3, 2005

(65) Prior Publication Data

US 2005/0199404 A1 Sep. 15, 2005

(30) Foreign Application Priority Data

Mar. 10, 2004 (JP) ..... 2004-068046
Dec. 1, 2004 (JP) ..... 2004-349000

(51) Int. Cl.
*B25D 15/02* (2006.01)

(52) U.S. Cl. ..... 173/104; 173/48; 173/93; 173/93.5

(58) Field of Classification Search ..... 173/48, 173/104, 93, 93.5, 216, 205, 109, 112, 178, 173/91
See application file for complete search history.

(56) References Cited

U.S. PATENT DOCUMENTS 3,736,992 A * 6/1973 Zander et al. ..... 173/48
4,098,351 A * 7/1978 Alessio ..... 173/13
4,567,950 A * 2/1986 Fushiya et al. ..... 173/48
5,458,206 A * 10/1995 Bourner et al. ..... 173/178
5,531,278 A * 7/1996 Lin ..... 173/176
5,842,527 A * 12/1998 Arakawa et al. ..... 173/48
6,015,017 A * 1/2000 Lauterwald ..... 173/48
6,035,945 A * 3/2000 Ichijyou et al. ..... 173/48
6,142,242 A * 11/2000 Okumura et al. ..... 173/48
6,192,996 B1 * 2/2001 Sakaguchi et al. ..... 173/48
6,688,406 B1 * 2/2004 Wu et al. ..... 173/48
6,691,796 B1 * 2/2004 Wu ..... 173/48
6,892,827 B1 * 5/2005 Toyama et al. ..... 173/48
6,913,090 B1 * 7/2005 Droste et al. ..... 173/109
6,976,545 B1 * 12/2005 Greitmann ..... 173/104

FOREIGN PATENT DOCUMENTS

JP B2 2828640 9/1998
JP B2 3372345 11/2002

* cited by examiner

*Primary Examiner*—Stephen F. Gerrity
*Assistant Examiner*—Brian Nash
(74) *Attorney, Agent, or Firm*—Oliff & Berridge, PLC

(57) ABSTRACT

An impact driver in which a drill mode can be selected without fail is provided. In a hammer case, a connecting sleeve is provided so as to be slidable back and forth. At the backward position, the connecting sleeve engages with only a first engaging tooth provided on the outer circumference of the hammer for rotating integrally. At the forward position, it engages with both the first engaging tooth of the hammer and a second engaging tooth of an anvil for rotating integrally with both of them, and thus a drill mode is obtained. Further, an operating bolt is provided in the hammer case to be inserted into a concave groove of the connecting sleeve through a guide groove formed in the hammer case. The operating bolt slides the connecting sleeve to the forward or backward position by its movement in the guide groove.

20 Claims, 13 Drawing Sheets

IMPACT DRIVER HAVING AN EXTERNAL MECHANISM WHICH OPERATION MODE CAN BE SELECTIVELY SWITCHED BETWEEN IMPACT AND DRILL MODES

BACKGROUND OF THE INVENTION

This application claims the benefit of Japanese Patent Application Number 2004-68046 filed Mar. 10, 2004 and Japanese Patent Application Number 2004-349000 filed Dec. 1, 2004, the entirety of which is incorporated by reference.

1. FIELD OF THE INVENTION

The present invention relates to an impact driver capable of applying rotation and the intermittent impact operation to an anvil protruding to the front of a housing.

2. DESCRIPTION OF THE RELATED ART

An impact driver has a well-known structure in which a spindle rotated by a motor is connected with a hammer through cam grooves and balls, and an anvil which is locked in the rotative direction is axially provided in front of the hammer, whereby rotation of the spindle is transferred to the anvil through the hammer. With this structure, when a load on the anvil exceeds a predetermined value, the hammer moves backward along the cam grooves to temporarily disengage from the anvil, and thereafter it moves forward by a coil spring biased to the front along the cam grooves to reengage with the anvil. By repeating the above operation, it is possible to apply the intermittent impact operation to the anvil in the rotative direction.

The above-described impact driver is generally used for screwing with a screw or a bolt etc. Thus, when it is used for boring a shallow hole on a material to be processed, a user has to handle two separate tools in turn, which are, an electric drill and an impact driver. Consequently, it is troublesome to exchange tools and therefore usability might be reduced.

In order to solve the above problem, Japanese Patent No. 2828640 discloses the invention in which a concave groove is provided at the outer circumference of a hammer while an operating handle is provided at a housing so as to move an engaging pin to be engaged with the concave groove in the axial direction. According to this structure, the engaging pin regulates the backward movement of the hammer by rotative operation of the operating handle, thereby a drill mode without the impact operation is achieved. Moreover, Japanese Patent No. 3372345 discloses the invention in which an anvil is provided so as to be movable in the axial direction. In addition, an engaging portion and a corresponding portion to be engaged are provided at the front end of the hammer and a hole of the anvil into which the front end of the hammer is inserted with play. According to this structure, when the anvil is located at a forward position it is disengaged from a claw of a hammer, and the engaging portion and the corresponding portion engage with each other. As a result, the hammer and the anvil are connected, so that a drill mode can be obtained.

However, Japanese Patent No. 2828640 discloses a structure in which the engaging pin compulsory regulates the backward movement of the hammer. Consequently, the engaging pin and the operating handle suffer from a heavy burden. As a result, when a load on the anvil increases the hammer might move backward to generate impact or the engaging pin might be broken, which deteriorates reliability.

Moreover, in Japanese Patent No. 3372345, a housing has to be extended in the axial direction in order to space a stroke of movement, and further the structure might be complex. As a result, operability might be lowered due to difficulty in downsizing or cost might be higher.

SUMMARY OF THE INVENTION

In order to solve this problem, an object of the present invention is to provide an impact driver in which selection of a drill mode is feasible with a simpler structure and a usability is excellent.

In order to achieve the above object, in a first aspect of the present invention, a connecting member is provided in a housing so as to be movable between a first slide position where the connecting member engages either a hammer or an anvil so as to rotate integrally with the hammer or the anvil and a second slide position where the connecting member engages both the hammer and the anvil to rotate integrally with both of them. Moreover, an operating means is provided in the housing for moving the connecting member to each of the two slide positions from outside of the housing.

In a second aspect of the present invention based on the first aspect, in order to simply form the connecting member and the operating means, the connecting member is formed as a sleeve having connecting teeth in its inner circumference for engaging with engaging teeth formed at the outer circumference of the anvil and the hammer, and the operating means is formed as an axis member which is inserted into a concave groove provided at the outer circumference of the sleeve through a guide groove formed in the housing and which guides the sleeve to the slide positions through its movement in the guide groove.

In a third aspect of the present invention based on the first aspect, in order to simply form the connecting member capable of engaging with or disengaging from the anvil smoothly, the connecting member is formed as a ring member externally provided on the hammer so as to be rotatable integrally as well as movable in the axial direction, and having a second engaging portion being attached to an engaging portion provided with the hammer for engaging with the anvil. With this structure, at the first slide position the ring member disengages from the anvil to rotate integrally with the hammer only, at the second slide position the second engaging portion is made to engage with the anvil, so that the hammer and the anvil rotate integrally.

According to the first aspect of the present invention, both boring and screwing can be conducted with an impact driver only, whereby improvement of its operability can be expected. In particular, the impact driver has a simple structure in which the connection status between the hammer and the anvil is switched using the connection member. Therefore, a drill mode is obtained without fail and enlargement of the housing is prevented, and the drill mode is feasible with a low cost. Moreover, when the connecting member engages with the hammer at the first slide position to select an impact mode, the hammer which is connected with the connecting member engages with the anvil, whereby the mass of the hammer itself which moves back and forth can be set to be smaller. As a result, vibration can be reduced in the impact mode, thereby maintaining excellent operability.

According to the second aspect of the present invention, in addition to the effect of the first aspect, the connecting member and the operating means for the same can be simply formed.

According to the third aspect of the present invention, in addition to the effect of the first aspect, the connecting member can be simply formed and can engage with or disengage from the anvil smoothly, thereby obtaining excellent operability.

BRIEF DESCRIPTION OF THE DRAWINGS

FIG. 2 is an explanation view of a guide groove.

DETAILED DESCRIPTION OF THE PREFERRED EMBODIMENTS

Hereinafter, preferred embodiments of the present invention will be explained with reference to the drawings.

First Embodiment

Figure 1:
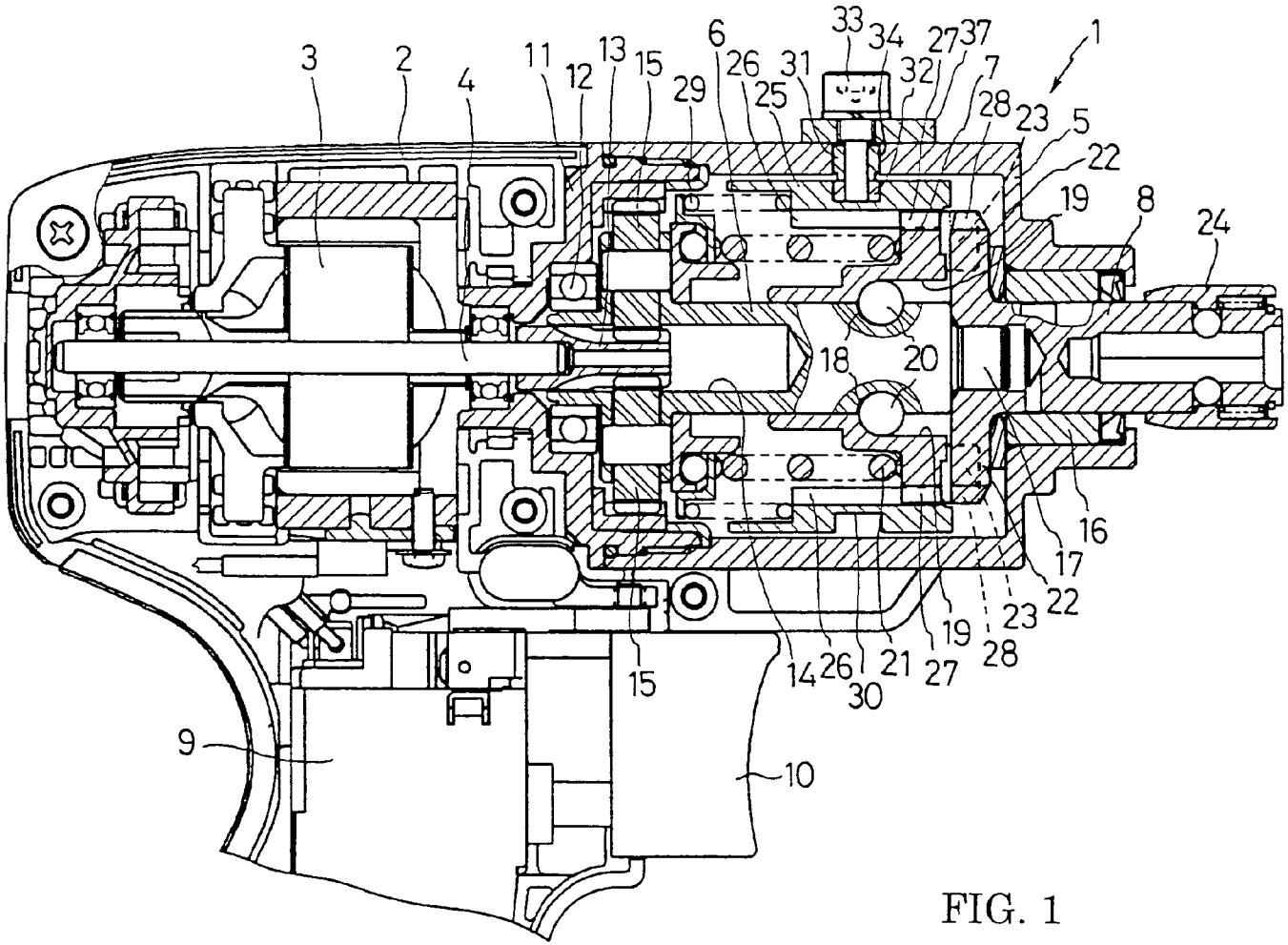
FIG. 1 is a partial vertical section view of an impact driver of the first embodiment (in an impact mode).

FIG. 1 is a partial vertical section view showing an example of an impact driver. An impact driver 1 has a motor 3 accommodated in a body housing 2. At the front of the body housing 2, a hammer case 5 accommodating a spindle 6 and a hammer 7 is incorporated as a front housing. An anvil 8 protrudes at the front of the hammer case 5. The reference number 9 denotes a switch and the reference number 10 denotes a trigger. Between the body housing 2 and the hammer case 5, a gear housing 11 is provided which axially supports a motor shaft 4 of the motor 3 so as to allow the motor shaft 4 to protrude into the hammer case 5. Moreover, the gear housing 11 axially supports the end of the spindle 6 through a ball bearing 12. A pinion 13 is mounted at the top of the motor shaft 4 which is inserted coaxially with play into a hollow portion 14 formed at the end of the spindle 6. In accordance with this structure, the motor shaft 4 engages with a plurality of planetary gears 15, 15 . . . which are axially provided at the rear outer circumference of the spindle 6 which receives the rotation speed of the motor shaft 4 with reduction.

The anvil 8 is axially supported at the front end of the hammer case 5 so as to rotate by means of a bearing 16. At the front end, the spindle 6 has a small-diameter portion 17 inserted coaxially into the end face of the anvil 8 with play. At the rear of the small-diameter portion 17, the hammer 7 is externally provided. The hammer 7 is connected to the spindle 6 so as to be integrally rotatable through two steel balls 20, 20 inserted in a manner that straddle both a pair of cam grooves 18, 18 formed with a slope at the outer circumference of the spindle 6 and a pair of connecting grooves 19, 19 formed in the axial direction at the inner circumference of the hammer 7 respectively. Moreover, the hammer 7 is pressed forward by a coil spring 21 provided externally to the spindle 6 at the rear of the hammer 7. At the front surface of the hammer 7, a pair of engaging portions 23, 23 is provided so as to engage with a pair of arms 22, 22 extending in the radial direction at the rear end of the anvil 8. When the hammer 7 is pressed forward as shown in FIG. 1, the engaging portions 23, 23 engage with the arms 22, 22, thereby allowing the hammer 7 to be integral with the anvil 8 in the rotative direction. The reference number 24 denotes a chuck sleeve externally provided at the top of the anvil 8 for locking a driver bit and the like inserted into the anvil 8.

In the hammer case 5, a connecting sleeve 25 serving as a connecting member is accommodated so as to be movable and rotatable in the axial direction in a manner that is externally provided on the hammer 7 and the anvil 8. The connecting sleeve 25 has connecting teeth 26, 26 . . . formed at its inner circumference in the axial direction with even intervals in the circumferential direction. The connecting teeth 26, 26 . . . can engage with first engaging teeth 27, 27 . . . formed at the outer circumference of the hammer 7 and second engaging teeth 28, 28 . . . formed at the outer circumference of the arms 22, 22 of the anvil 8, respectively. The reference number 29 denotes a coil spring located at the rear of the connecting sleeve 25. The coil spring 29 presses the connecting sleeve 25 to a forward position where it engages with the hammer 7 and the anvil 8 simultaneously.

At the outer circumference of the connecting sleeve 25, a concave groove 30 is formed in the circumferential direction. A tip of an operating bolt 33 serving as an operating means, on which sleeves 31, 32 are externally provided and which is penetrating the hammer case 5 is inserted into the concave groove 30. Consequently, the connecting sleeve 25 is regulated its forward position by the operating bolt 33. As shown in FIG. 2, in a portion through which the operating bolt 33 penetrates in the hammer case 5, an L-shaped guiding groove 34 is formed. The guiding groove 34 consists of a first groove 35 formed in the circumferential direction of the hammer case 5 and a second groove 36 formed in the axial direction which extends from the end of first groove 35. With this configuration, the operating bolt 33 with the connecting sleeve 25, which is biased forward by the coil spring 29, can change its position in the axial direction in accordance with its position in the guiding groove 34. As shown in FIG. 3, the reference number 37 denotes a curved slide plate which is positioned between the tip of the operating bolt 33 and the hammer case 5 and with which the head of the operating bolt 33 is threadedly engaged. The slide plate 37 slides integrally with the operating bolt 33 at the outer circumference of the hammer case 5 so as to close off the outside of the guide groove 34, thereby preventing intrusion of dust into the hammer case 5.

Figure 2A:
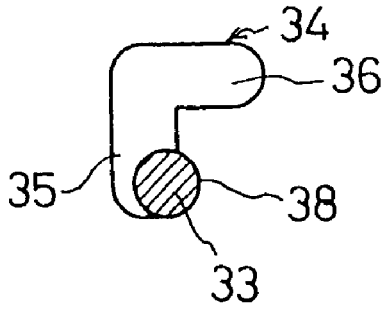
FIG. 2A shows a position of an operation bolt in the impact mode and FIG. 2B shows a position of the same in a drill mode.
Figure 2B:
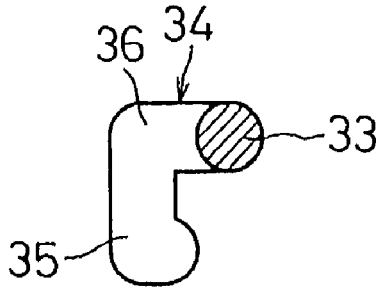
Figure 3:
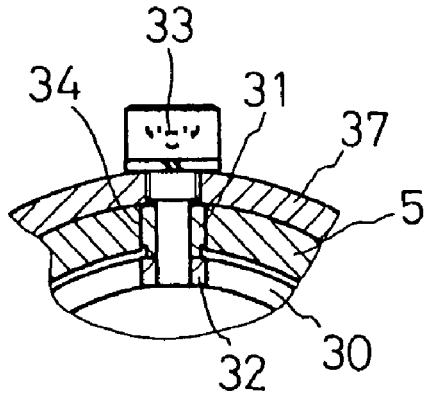
FIG. 3 is a partial transverse cross section view of a hammer case showing a portion of the operation bolt.
Figure 4:
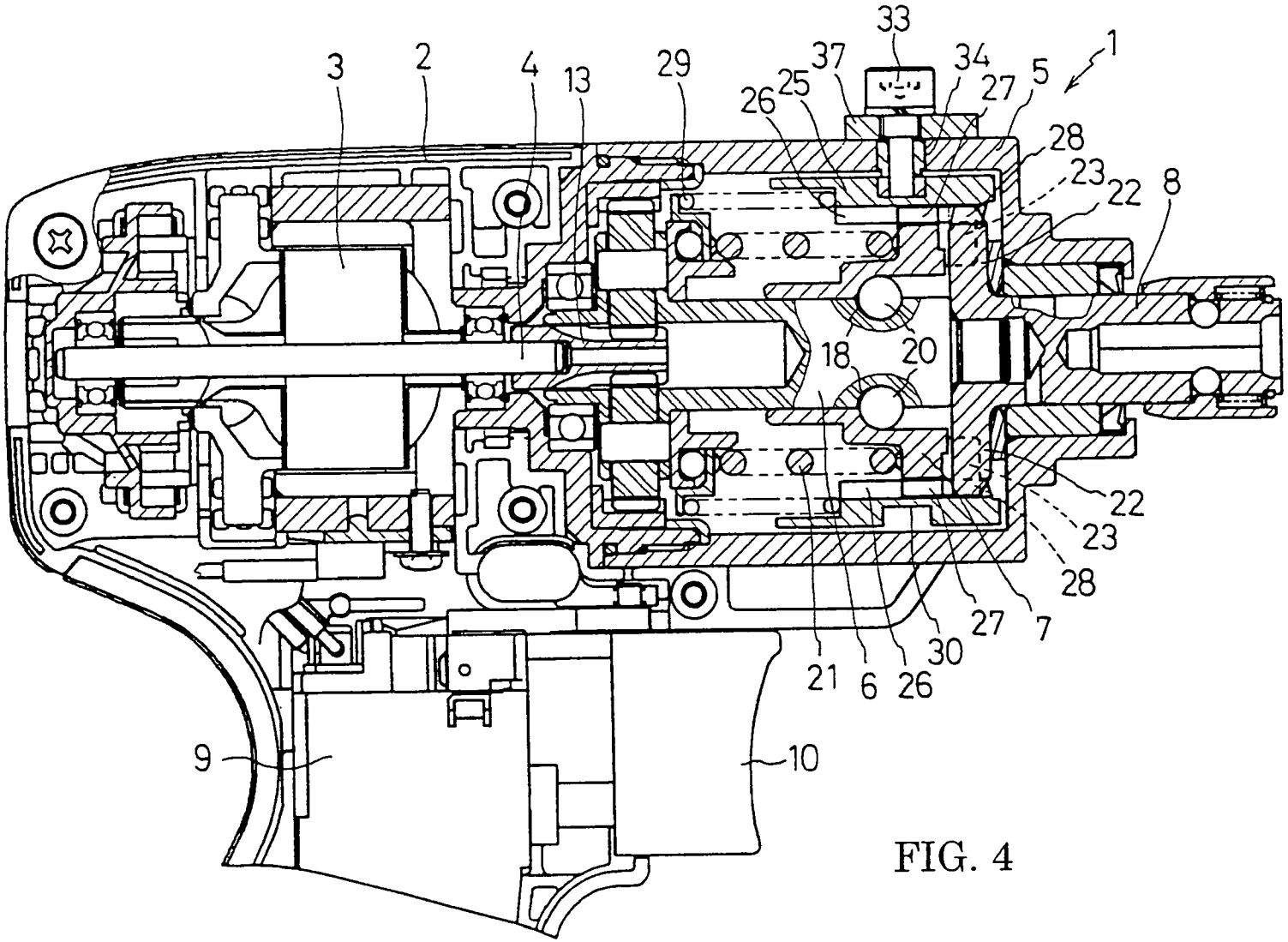
FIG. 4 is a partial vertical section view of an impact driver (in a drill mode).

In the above configuration, when the operating bolt 33 is moved to the end of the first groove 35 in the guide groove 34 to engage with an engaging concave portion 38 at the end of the first groove 35 as shown in FIG. 2A, the operating bolt 33 with the connecting sleeve 25 is locked at the backward position (a first slide position). As shown in FIG. 1, at the backward position the connecting tooth 26 of the connecting sleeve 25 engages with the first engaging tooth 27 of the hammer 7 only, whereby the connecting sleeve 25 rotates integrally with the hammer 7 (an impact mode). On the other hand, when the operating bolt 33 is moved to the front end of the second groove 36 as shown in FIG. 2B, the operating bolt 33 with the connecting sleeve 25 is locked at the forward position (a second slide position). As shown in FIG. 4, at the forward position, the connecting tooth 26 of the connecting sleeve 25 engages with the first engaging tooth 27 of the hammer 7 and the second engaging tooth 28 of the anvil 8 simultaneously, whereby the hammer 7 and the anvil 8 are connected to rotate integrally through the connecting sleeve 25 (a drill mode).

In the above-structured impact driver 1, when the operating bolt 33 is locked in the engaging concave portion 38 of the first groove 35, the impact mode is selected as shown in FIG. 1. Then, when the trigger 10 is pressed to turn ON the switch 9 in order to drive the motor 3, the rotation speed of the motor shaft 4 is transferred to the spindle 6 with reduction. As a result, the anvil 8 is rotated through the hammer 7. With this mechanism, screwing can be performed using a driver bit and the like attached at the top of the anvil 8. While this screwing, the connecting sleeve 25 engaged with the hammer 7 also rotates integrally with the spindle 6. In this case, however, the operating bolt 33 is relatively slides in the concave groove 30, so that the connecting sleeve 25 and the hammer 7 are freely rotatable not influenced by the operating bolt 33.

When screwing proceeds to a state in which a load on the anvil 8 increases, the steel balls 20, 20 are rolled backward along the cam grooves 18, 18 of the spindle 6. Consequently, the hammer 7 is moved backward against the biasing force of the coil spring 21 until it disengages from the anvil 8. However, at the moment of this disengagement the hammer 7, which is rotating with the spindle 6, immediately moves forward again being pressed by the coil spring 21 until the engaging portions 23, 23 engage with the arms 22, 22 of the anvil 8. These disengagement and reengagement of the hammer 7 with respect to the anvil 8 are mechanically repeated, which leads to the intermittent impact operation to the anvil 8 in the rotative direction. In this way, tight screwing can be conducted. It should be noted that even when the hammer 7 moves back and forth, the engagement situation of the connecting tooth 26 of the connecting sleeve 25 is maintained, so that the connecting sleeve 25 always rotates integrally with the hammer 7.

On the other hand, when the drill mode is selected by moving the operating bolt 33 to the front end of the second groove 36 as shown in FIG. 4, the connecting sleeve 25 moves forward to connect the hammer 7 and the anvil 8 integrally, so that a torque of the spindle 6 is transferred from the hammer 7 to the anvil 8 through the connecting sleeve 25. Therefore, the anvil 8 keeps rotating at an even speed irrespective of a load on the anvil 8, so that an impact does not occur to the anvil 8 even when the hammer 7 disengages from the anvil 8.

In the impact driver 1 in accordance with the first embodiment, both boring and screwing can be conducted only with the impact driver, whereby improvement of its operability can be expected. In particular, the impact driver has a simple structure in which the connection status between the hammer 7 and the anvil 8 is switched using the connecting sleeve 25. Therefore, a drill mode is obtained without fail and enlargement of the hammer case 5 is prevented, and the drill mode is feasible with a low cost. Moreover, when the hammer 7 engages with the anvil 8 through the connecting sleeve 25 in an impact mode, the hammer 7 which is connected with the connecting sleeve 25 engages with the anvil 8, whereby the mass of the hammer 7 itself which moves back and forth can be set to be smaller. As a result, vibration can be reduced in the impact mode, thereby maintaining excellent operability.

Moreover, the connecting member is formed as the connecting sleeve 25 having the connecting tooth 26 capable of engaging with the first and second engaging teeth 27, 28 formed at the outer circumference of the hammer 7 and the anvil 8. On the other hand, the operating means is formed as the operating bolt 33 inserted into the concave groove 30 provided at the outer circumference of the connecting sleeve 25 through a guide groove 34 formed in the hammer case 5. The operating bolt 33 guides the connecting sleeve 25 to a forward or backward position through its movement in the guide groove 34. In this way, the connecting member and the operating means can be easily obtained.

In the first embodiment, the connecting sleeve is biased from backward. Alternatively, it is acceptable to provide a coil spring in front of the connecting sleeve in order to press from the front. Moreover, other elastic body, such as a plate spring, may be adopted other than the coil spring. Further, this kind of biasing means may be omitted as long as the operation bolt can be fixed at a predetermined slide position by modifying the shape of the guide groove or providing other stopper means.

With respect to the axis member, a pin may be adopted other than the operating bolt and it is not limited to the structure in which the axis member itself is operated. For example, a rotating lever having an eccentric pin to be inserted into a concave groove of a connecting sleeve may be attached on a hammer case. With this configuration, it is possible to obtain the axial movement of the eccentric pin by rotative operation of the rotating lever.

With respect to the connecting member, the connecting sleeve may be shortened in the axial direction. Further, the connecting member may be located at a slide position for engaging with the anvil only, and then it moves backward to engage with the hammer and the anvil, not limited to the above-described structure in which the connecting member moves forward from a position for engaging with the hammer only. Still further, the connecting member may be located at a position for engaging with neither the hammer nor the anvil, and then it moves to either of two positions, which are, a position for engaging with each of the hammer or the anvil and a position for engaging with the hammer and the anvil.

Second Embodiment

Next, another embodiment of the present invention will be explained.

Figure 5:
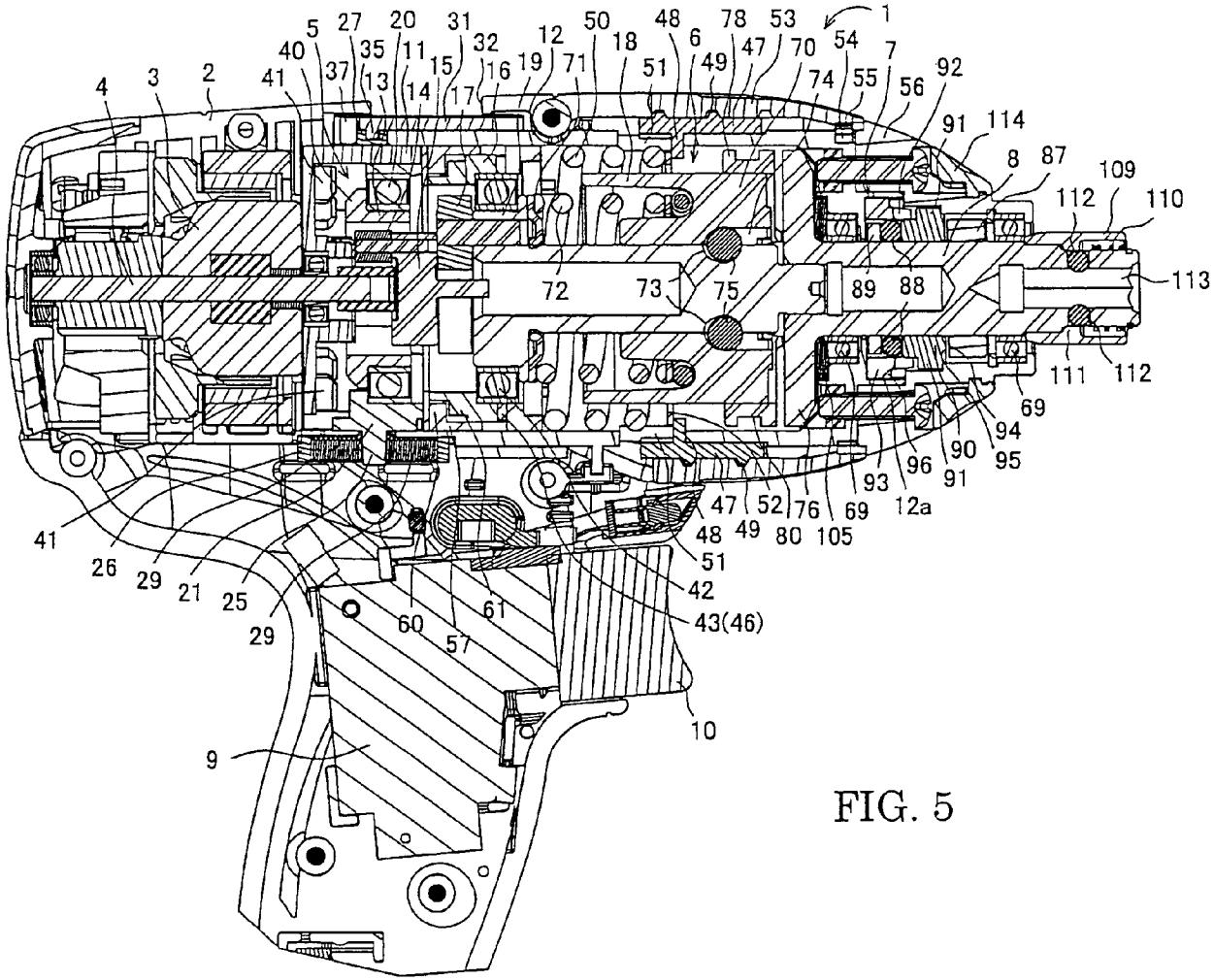
FIG. 5 is a vertical section view of an impact driver of the second embodiment.

As shown in FIG. 5, an impact driver has a motor 3 accommodated at the rear of a body housing 2 formed of a pair of right and left half-housings. In front of the motor 3, a planetary gear reduction mechanism 5 with a clutch mechanism, an impact mechanism 6 and a percussion mechanism 7 are respectively provided, and an anvil 8 coaxially provided with a motor shaft 4 of the motor 3 is protruding at the front end. The reference number 9 denotes a switch of a driving circuit of the motor 3, and the reference number 10 denotes a trigger for turning ON the switch 9 when the trigger is pressed.

Figure 6:
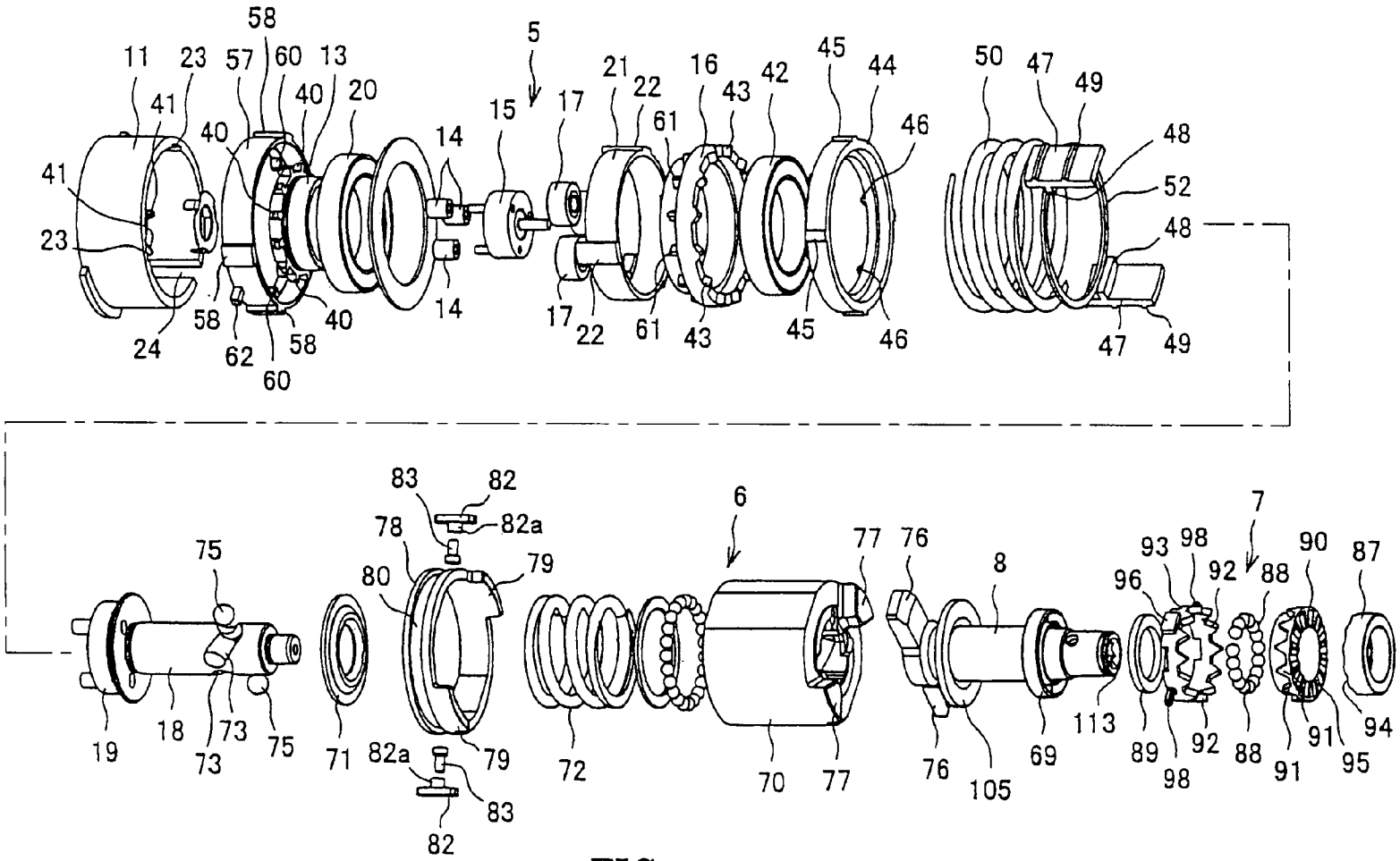
FIG. 6 is an exploded perspective view of an inner mechanism.
Figure 7:
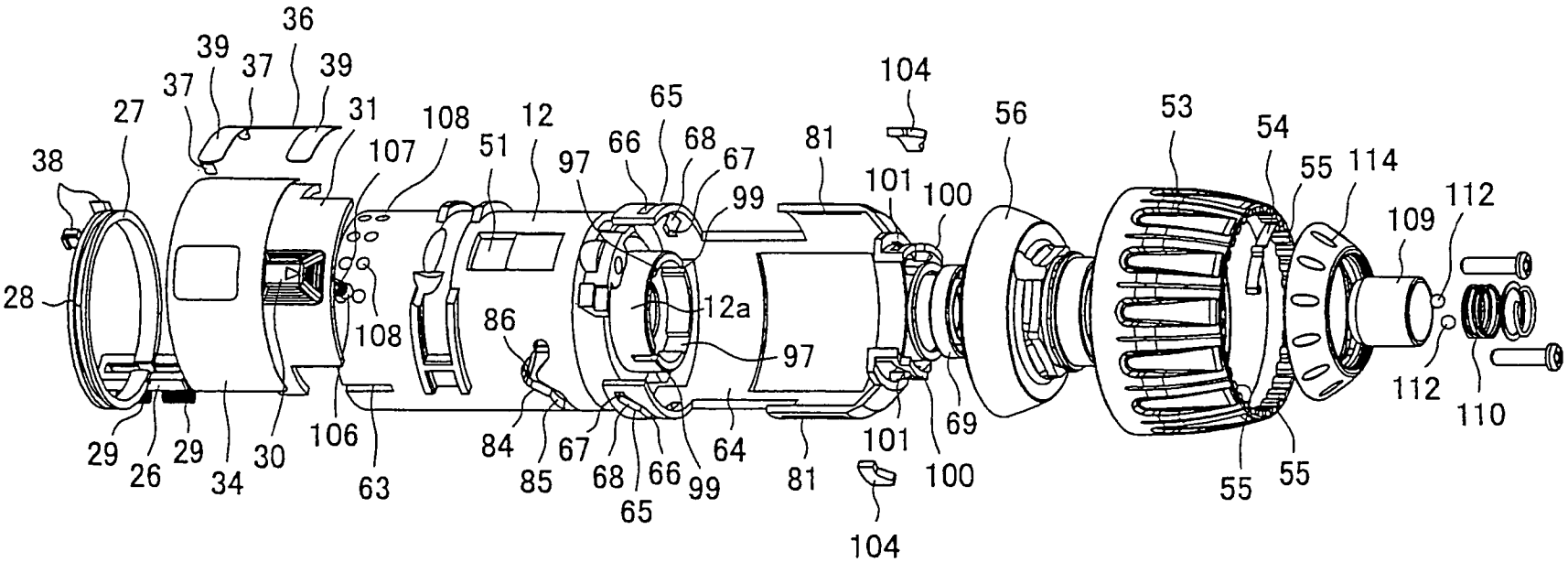
FIG. 7 is an exploded perspective view of the inner mechanism.

As shown in FIGS. 6 and 7, the planetary gear reduction mechanism 5 is housed between a cylindrical motor bracket 11 and a gear case 12. The motor bracket 11 is fixed in the body housing 2 and axially supports the motor shaft 4. The gear case 12 is connected in front of the motor bracket 11 and formed in a cylindrical shape having a slightly larger diameter than the motor bracket 11. That is, the planetary gear reduction mechanism 5 includes three planetary gears 14, 14 . . . , a carrier 15, three planetary gears 17, 17 . . . and a spindle 18. The planetary gears 14, 14 . . . engage with a pinion fitted on the motor shaft 4 and are rotatable in a first internal gear 13. The carrier 15 supports the planetary gear 14. The planetary gears 17, 17 . . . engage with an output shaft portion in front of the carrier 15 and are rotatable in a second internal gear 16 as the next layer. The spindle 18 has a carrier portion 19 supporting the planetary gear 17 and is coaxially inserted into the rear surface of the anvil 8 with play. With this configuration, the rotation speed of the motor shaft 4 can be transferred to the spindle 18 with two-staged reduction.

Figure 9B:
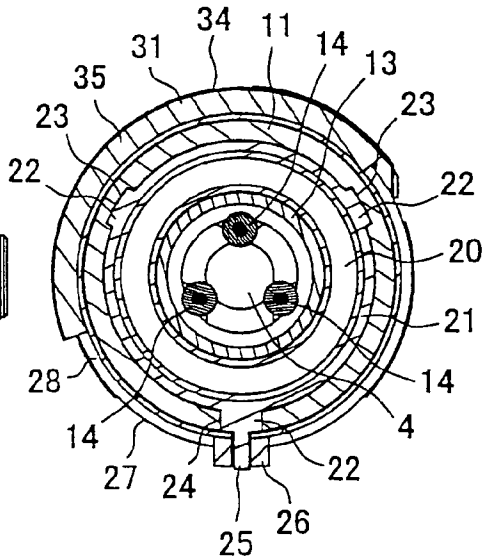
FIG. 9B is a section view taken along line A—A.

Here, the first internal gear 13 is axially supported so as to be rotatable by a ball bearing 20 in the motor bracket 11. As shown in FIG. 9B, a speed switching ring 21 supporting the ball bearing 20 is movable back and forth in the axial direction. In addition, the speed switching ring 21 is regulated its rotation by engagement of the three projections 22, 22 . . . provided outwardly in the axial direction at the outer circumference of the speed switching ring 21 with respect to two guide grooves 23, 23 . . . and a slit 24 provided with a concavity corresponding to the projections 22, 22 . . . in the motor bracket 11. Among the three projections 22, 22 . . . of the speed switching ring 21, one projection 22 engaging with the slit 24 has a connecting piece 25 protruding in the radial direction and inserted with play into a rectangular frame 26 provided at the outside of the motor bracket 11. The frame 26 is externally provided on the motor bracket 11 and orthogonally connected to a ring-shaped speed switching lever 27 which is provided so as to move back and forth between a forward position where the switching lever 27 abuts to the rear end of the gear case 12 and a backward position where it abuts to a step portion provided on the inner surface of the body housing 2. At the outer circumference of the speed switching lever 27, a concave groove 28 is provided in the circumferential direction except a portion of a frame 26. In the frame 26, coil springs 29, 29 are internally provided back and forth so as to sandwich the connecting piece 25.

Figure 8:
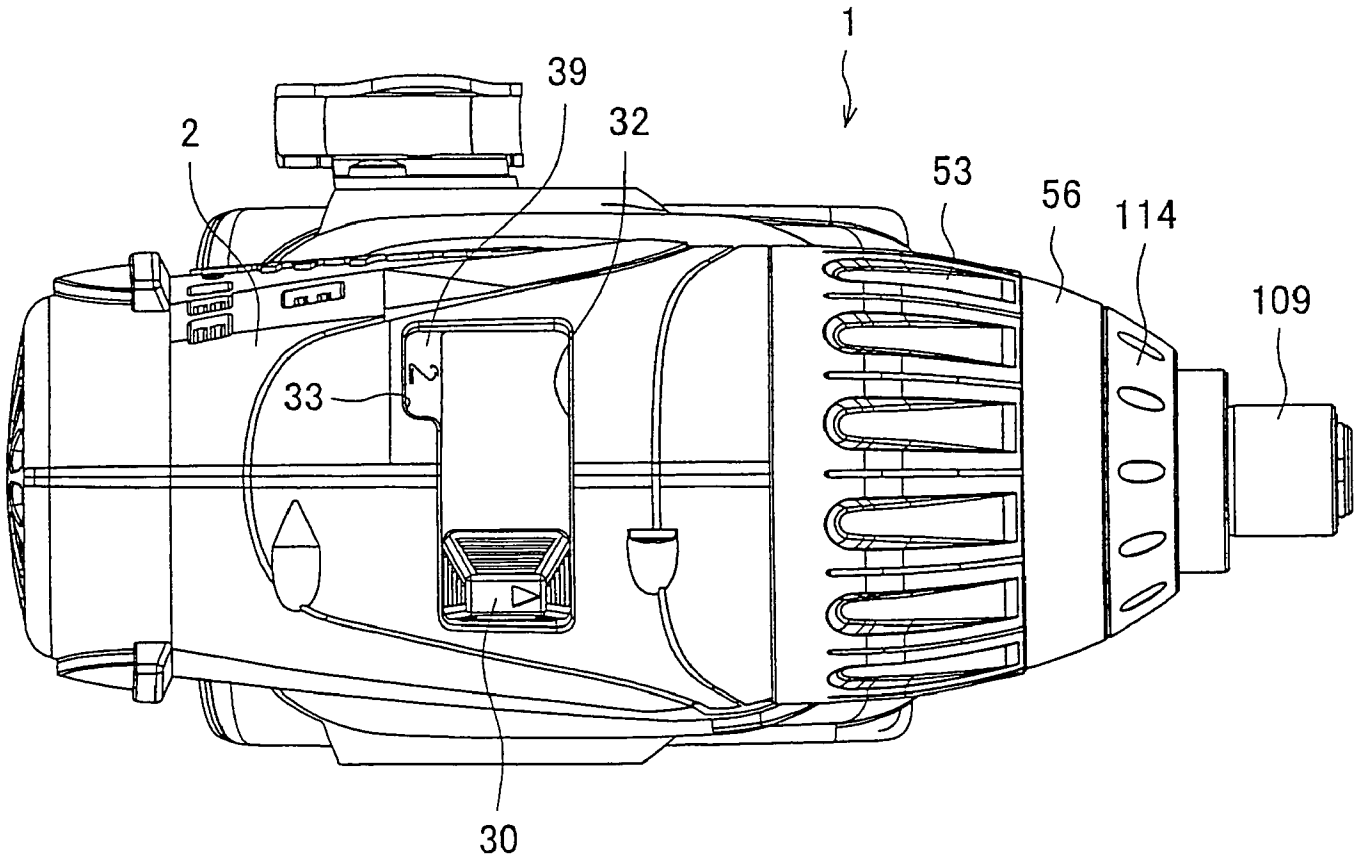
FIG. 8 is a plain view of an impact driver.

On the other hand, at the outer circumference of the gear case 12, a curved switching plate 31 having a switching button 30 at the top thereof is provided. As shown in FIG. 8, the switching plate 31 exposes the switching button 30 through a rectangular window 32 provided on the top of the body housing 2 in the lateral direction. The switching plate 31 is movable in the circumferential direction of the gear case 12 regulated within the range of movement of the switching button 30 in the window 32. At the left end of the window 32 a retracting portion 33 in which the switching button 30 can move backward is integrally provided, so that when the switching button 30 is slid at the left end into the retracting portion 33, the switching plate 31 is moved backward. On the switching plate 31, a thin rectangular protecting plate 34 exposing only the switching button 30 is set. The protecting plate 34 always covers the entire surface of the window 32 to prevent dust from intruding irrespective of each slide position of the switching button 30.

At the inner surface of the switching plate 31, a connecting projection 35 inserted into a concave groove 28 of a speed switching lever 27 is projecting, whereby the speed switching lever 27 can follow the back-and-forth movement of the switching plate 31. Similarly, between the body housing 2 and the protecting plate 34, an indicating plate 36 having an open-boxed shape in a plain view is set. The indicating plate 36 has folding pieces 37, 37 protruding in the downward direction formed at rear lateral ends to be locked at the outer side of a pair of L-shaped stopper pieces 38, 38 formed on the rear upper end of the speed switching lever 27. With this configuration, the switching button 30 can engage with the indicating plate 36 at the left end of the window 32. The indicating plate 36 contributes to connection between the speed switching lever 27 and the switching plate 31, while it enables indicating pieces 39, 39 positioned both in front and rear of the switching button 30 to be exposed in the window 32 alternatively in accordance with the forward and backward position of the switching button 30 for achieving recognition of the numbers appearing on the surface.

According to the above, when the switching button 30 is operated at the left end of the window 32 to move the switching plate 31 back and forth, the speed switching ring 21 and the first internal gear 13 move back and forth accordingly through the speed switching lever 27. Here, when the speed switching ring 21 and the first internal gear 13 are located at a forward position, they engage with the planetary gear 14 and the carrier 15 in the first layer simultaneously. On the other hand, when the speed switching ring 21 and the first internal gear 13 are located at a backward position, they engage with only the planetary gear 14 and disengage from the carrier 15. At the rear circumference of the first internal gear 13, engaging teeth 40, 40 . . . protrude with an even interval in the circumferential direction. At the backward position of the first internal gear 13, the engaging teeth 40, 40 . . . engage with engaging teeth 41, 41 . . . protruding at the bottom of the motor bracket 11 to regulate the rotation of the first internal gear 13. Consequently, at the backward position of the internal gear 13 the rotation speed of the motor shaft 4 of the motor 3 is transferred to the carrier 15 with reduction by means of the planetary gear 14 which orbitally rotates in the first internal gear 13. This causes a slow mode in which two-staged speed reduction is conducted by the planetary gear reduction mechanism 5. At the forward position of the first internal gear 13, a high speed mode can be obtained in which the rotation of the motor shaft 4 is directly transferred to the carrier 15.

Here, at a forward position of the switching button 30, the indicating plate 36 exposes the rear indicating piece 39 on the retracting portion 33 of the window 32 to exhibit the number "2" showing the high speed mode. On the other hand, at a backward position of the switching button 30, the indicating plate 36 exposes the front indicating piece 39 in the window 32 to exhibit the number "1" showing the slow mode. Moreover, the first internal gear 13, the carrier 15 and the engaging tooth 41 might be misaligned when the first internal gear 13 is slid to engage with the others. Even in this case, the switching operation can always be conducted smoothly because the speed switching lever 27 is moved to an appropriate position by means of elastic deformation of the coil springs 29, 29. In this case, since the switching lever 27 is kept biased by the coil spring 29, the first internal gear 13 and the speed switching ring 21 are slid back and forth to be located at an appropriate position engaging with each other appropriately when the motor shaft 4 rotates.

The second internal gear 16 is provided in the gear case 12 so as to be rotatable holding a ball bearing 42 which axially supports a carrier 19 of the spindle 18. At the front surface of the second internal gear 16, engaging projections 43, 43 . . . with lateral sides sloped in the circumferential direction are positioned with even intervals in the circumferential direction. In front of the second internal gear 16, a pressing ring 44 is provided so as to be movable in the axial direction. The pressing ring 44 is regulated its rotation by engagement between projections 45, 45 . . . formed on the outer surface of the pressing ring 44 in the axial direction and a concave groove (not shown) provided on inner surface of the gear case 12. In the pressing ring 44, engaging projections 46, 46 . . . having the same shape as the engaging projections 43, 43 . . . for engaging with each other are provided with even intervals in the circumferential direction on the rear surface opposing to the second internal gear 16. In front of the pressing ring 44, a coil spring 50 whose front end is received by a pair of pushers 47, 47 is provided so as to press the pressing ring 44 backward. The pushers 47, 47 are plates provided at the outer surface of the gear case 12 symmetrically disposed to the axis for protruding stopper pieces 48, 48 provided on inner surface of the pusher 47 into the gear case 12 through openings 51, 51 formed in the gear case 12. The stopper pieces 48, 48 receive the front end of the coil spring 50 through a washer 52. On the outer surface of the pushers 47, 47, a male screw portion 49 is formed respectively.

With this configuration, the second internal gear 16 is regulated its rotation being pressed and fixed by the coil spring 50 and the pressing ring 44. On the gear case 12 provided in front of the body housing 2, a cylindrical change ring 53 having a female screw portion in its inner circumference is externally provided so as to be rotatable. The change ring 53 engages with the male screw portion 49 of the pushers 47, 47. Consequently, when the pushers 47, 47 are screwed in the axial direction by rotating operation of the change ring 53, biasing force on the pressing ring 44 can be changed by contracting or expanding the coil spring 50 in the axial direction. At the front end outer circumference of the gear case 12, a leaf spring 54 is fitted. The leaf spring 54 engages with internal teeth 55, 55 . . . formed at the top inner circumference of the change ring 53. Accordingly, click operation can be obtained when the change ring 53 is rotated. The reference number 56 denotes a hammer case screwed to be fixed to the gear case 12 in front of the change ring 53 and axially supporting the anvil 8. A ring-shaped bumper 114 made of rubber is provided in front of the hammer case 53 serving as a blinder for a screw portion as well as a protector of a material to be processed from damage caused by abutment with the front portion of the impact driver 1.

Figure 10C:
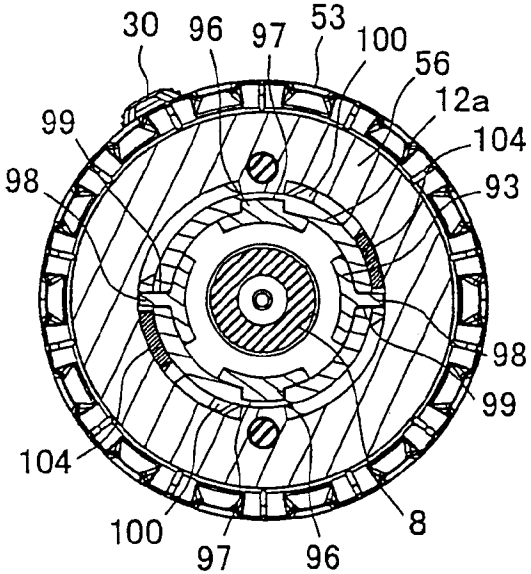
FIG. 10C is a section view taken along line D—D.
Figure 10B:
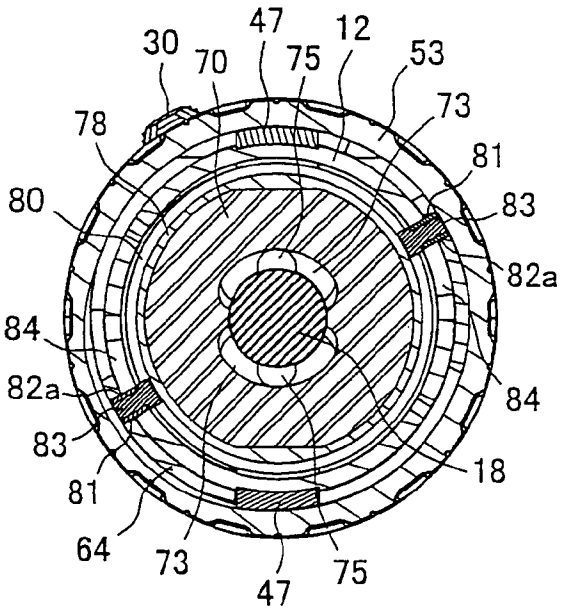
FIG. 10B is a section view taken along line C—C.
Figure 10A:
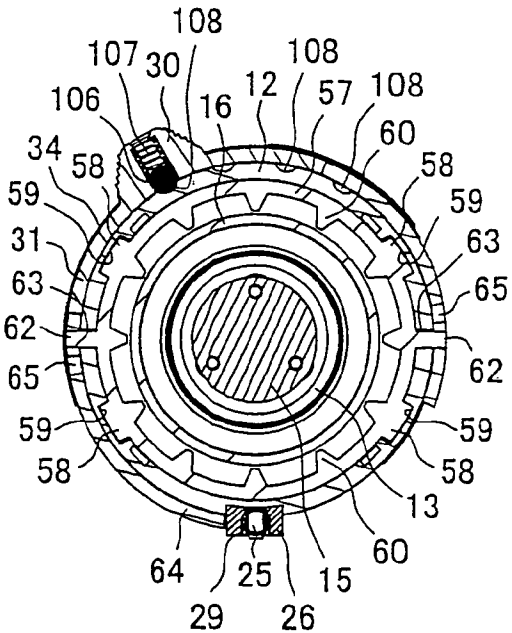
FIG. 10A is a section view taken along line B—B.

As shown in FIG. 10A, at the outer circumference of the second internal gear 16, a ring-shaped clutch switching lever 57 is externally provided so as to be movable back and forth in the axial direction. The clutch switching lever 57 is regulated the rotation by engagement between projections 58, 58 . . . provided at the outer circumference of the clutch switching lever 57 in the axial direction and concave grooves 59, 59 . . . provided at the rear end inner circumference of the gear case 12. At a forward position of the clutch switching lever 57, engaging teeth 60, 60 . . . provided at the inner circumference thereof engage with engaging teeth 61, 61 . . . provided at the rear outer circumference of the second internal gear 16. Whereby, the rotation of the second internal gear 16 is regulated irrespective of biasing force of the coil spring 50. At the outer circumference of the clutch switching lever 57, a pair of connecting projections 62, 62 as a connecting body is symmetrically disposed about a point in the radial direction. The connecting projections 62, 62 penetrate through slits 63, 63 as regulating grooves formed in the gear case 12 in the axial direction so as to protrude outside of the gear case 12.

Figure 9A:
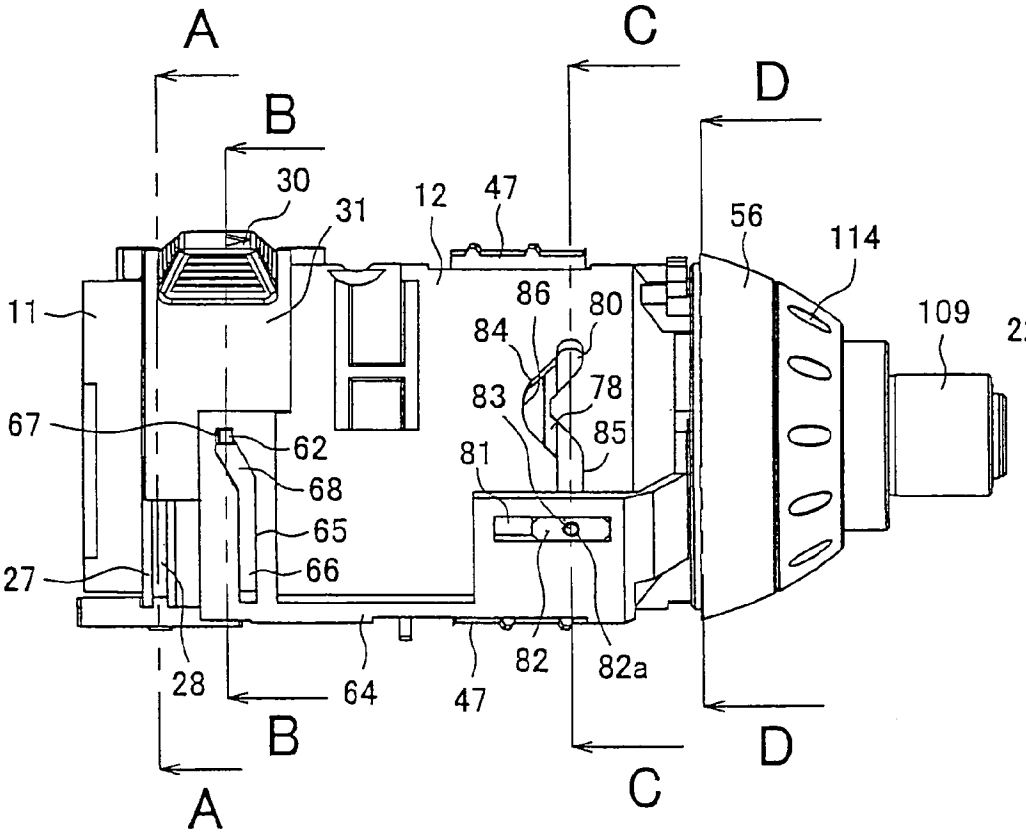
FIG. 9A is a side view of a gear case portion.

At the outer circumference of the gear case 12, a semi-cylindrical switching case 64 with a slight larger diameter than the gear case 12 is externally provided so as to be rotatable. The switching case 64 has a rear notch portion in which a switching plate 31 is fitted. Consequently, in accordance with sliding movement of the switching plate 31 in the circumferential direction, the switching case 64 rotates integrally with the switching plate 31. At the rear end portion of the switching case 64, a pair of clutch switching grooves 65, 65 symmetrically disposed about a point is formed to which the connecting projection 62 of the clutch switching lever 57 is inserted respectively. As shown in FIG. 9A, each clutch switching groove 65 has a first groove 66 extending along the circumference of the switching case 64, a second groove 67 located behind the first groove 66 by a predetermined distance and extending along the circumference of the switching case 64, and an inclined groove 68 connecting the first groove 66 and the second groove 67. Here, the connecting projection 62 is regulated its movement in the circumferential direction by a slit 63. The connecting projection 62 is moved in the clutch switching groove 65 in accordance with rotation of the switching case 64, thereby operation of the clutch switching lever 57 for moving back and forth can be conducted from outside through the connecting projection 62. The clutch switching lever 57 is at a forward position when the connecting projection 62 is located at the first groove 66, and the clutch switching lever 57 is at a backward position when the connecting projection 62 is located at the second groove 67.

The impact mechanism 6 includes an anvil 8 axially supported by a small cylindrical portion 12*a* provided at the front of the gear case 12 and the hammer case 56 through ball bearings 69, 69, a spindle 18 inserted coaxially into the rear of the anvil 8 with play, a hammer 70 externally provided on the spindle 18, and a coil spring 72 whose rear end is received by a cap washer 71 which is fitted on the spindle 18 for pressing the hammer 70 forward. As shown in FIG. 10B, the hammer 70 is connected with the spindle 18 by two steel balls 75, 75 inserted so as to straddle both a pair of V-shaped cam grooves 73, 73 formed at the outer circumference of the spindle 18 and connecting groove 74, 74 formed at the inner circumference of the hammer 70 in the axial direction. The hammer 70 is biased by a coil spring 72 to a forward position where the steel ball 75 is positioned at the front end of the cam groove 73 (that is, the front end of the V-groove) and the rear end of the connecting groove 74. At the front surface of the hammer 70, a pair of engaging portions 77, 77 having a quarter sector shape seen from the front for engaging with a pair of arms 76, 76 extending radially at the rear end of the anvil 8. At the forward position of the hammer 70 as shown in FIG. 5, the engaging portions 77, 77 engage with the arms 76, 76 to rotate the hammer 70 and the anvil 8 integrally.

An auxiliary ring 78 is externally provided on the hammer 70 for serving as a ring member of the present invention. The auxiliary ring 78 has a pair of chamfered surfaces to be rotatable integrally with the hammer 70 as well as movable independently in the axial direction. On the front surface of the auxiliary ring 78, curved auxiliary engaging portions 79, 79 serving as a second engaging portion are projecting so as to be attached to the engaging portions 77, 77 of the hammer 70. At a forward position, the auxiliary engaging portions 79, 79 together with the engaging portions 77, 77 of the hammer 70 engage with the arms 76, 76. At the outer circumference of the auxiliary ring 78, a concave groove 80 is provided in the circumferential direction. In the switching case 64, rectangular guide bodies 82, 82 having a cylindrical body 82*a* in its center are provided so as to be movable back and forth in a pair of slits 81, 81 formed in the axial direction. As shown in FIGS. 9A and 10B, a stepped pin 83 inserted into the cylindrical body 82*a* of each guide body 82 penetrates a pair of impact switching grooves 84, 84 formed on the gear case 12, and the top of the stepped pin 83 is inserted with play into the concave groove 80 of the auxiliary ring 78.

The impact switching groove 84 consists of a first groove 85 formed in the circumferential direction of the gear case 12 and a second groove 86 bent in a V shape from the end of the first groove 85. In accordance with rotation of the switching case 64, the stepped pins 83, 83 together with the guide bodies 82, 82 regulated its circumferential movement in the slits 81, 81 are moved in the impact switching grooves 84, 84. As a result, the auxiliary ring 78 is moved back and forth from outside through the stepped pin 83. In other words, the switching button 30, the switching plate 31, the switching case 64, the slit 81, the stepped pin 83 and the impact switching groove 84 serve as an operating means of the auxiliary ring 78. When the stepped pin 83 is positioned in the first groove 85 and the guide body 82 is at a forward position, the auxiliary ring 78 is at a forward position (a second slide position). On the other hand, when the stepped pin 83 is positioned at the summit of the V-shaped second groove 86 and the guide body 82 is at a backward position, the auxiliary ring 78 is at a backward position (a first slide position). In the impact switching groove 84, the cylindrical body 82*a* externally provided on the stepped pin 83 is slid with the guide body 82. This dual structure of the cylindrical body 82*a* and the stepped pin 83 ensures to enhance the mechanical strength of the stepped pin 83. As a result, the stepped pin 83 can slide in the impact switching groove 84, so that the auxiliary ring 78 can be moved without fail.

In the hammer case 56, the percussion mechanism 7 is provided. The percussion mechanism 7 has a first cam 87, a second cam 90 and a percussion switching lever 93. The first cam 87 is integrally fitted on the anvil 8 between the ball bearings 69, 69. The second cam 90 is externally provided on the anvil 8 at the rear of the first cam and regulated its backward movement by balls 88, 88 . . . and a flat washer 89. The percussion switching lever 93 is in a ring shape and provided in the small cylindrical portion 12*a* of the gear case 12 at the rear of the second cam 90. The percussion switching lever 93 has engaging teeth 92, 92 . . . at the front end thereof for engaging with engaging teeth 91, 91 . . . formed at the outer circumference of the second cam 90. The first cam 87 and the second cam 90 have cam teeth 94, 94 . . . and 95, 95 . . . on opposing surfaces thereof respectively for engaging with each other when they are contacted. The second cam 90 and the percussion switching lever 93 serve as a releasing means of the percussion mechanism 7.

Figure 11A:
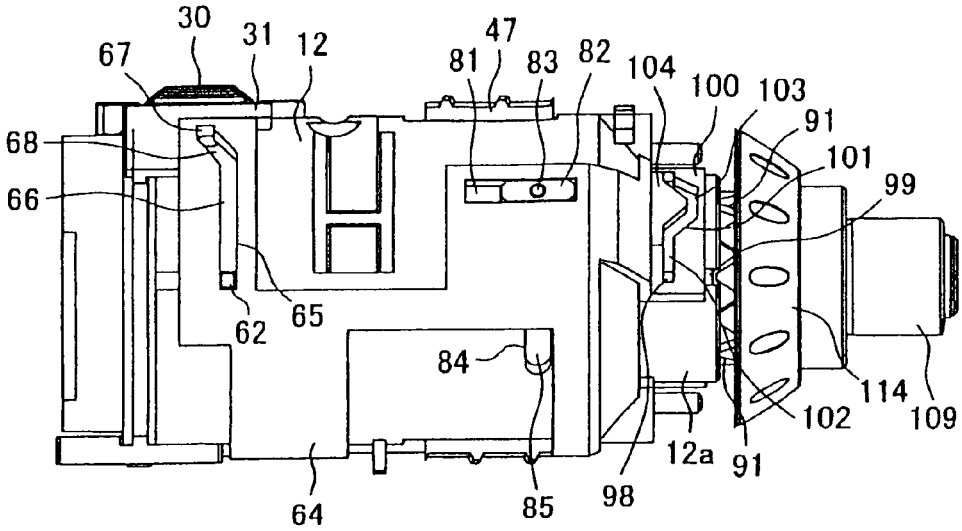
FIG. 11A shows a lateral view of a gear case portion in the drill mode.
Figure 11B:
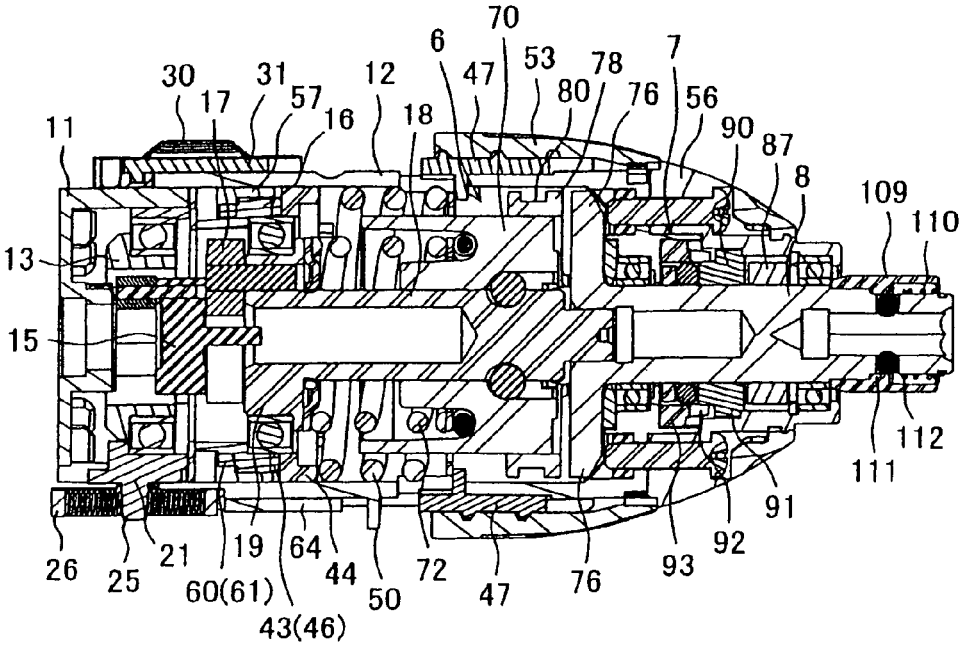
FIG. 11B shows a vertical section view of a gear case portion in the drill mode (a change ring and the hammer case are also shown).

As shown in FIG. 10C, the percussion switching lever 93 is held in the small cylindrical portion 12*a* so as to be movable back and forth and regulated its rotation by engagement between projections 96, 96 . . . provided at the outer circumference and concave portions 97, 97 . . . provided on an inner surface of the small cylindrical portion 12*a*. Moreover, a pair of connecting projections 98, 98 is radially provided at the outer circumference between the projections 96, 96 . . . in order to penetrate slits 99, 99 provided in the small cylindrical portion 12*a*. The connecting projections 98, 98 are inserted with play into a pair of curved guide plates 100, 100 provided at the front end of the switching case 64. As shown in FIG. 11, in order to insert the connecting projection 98 with play in each guide plate 100, a percussion switching groove 101 is provided which is consisting of a first groove 102 along the circumference direction of the switching case 64 and a second groove 103 bent forward in a trapezoidal shape from the end of the first groove 102. In accordance with rotation of the switching case 64, the connecting projections 98, 98 regulated its circumferential movement in the slits 99, 99 are moved in the percussion switching grooves 101, 101, thereby moving the percussion switching lever 93 back and forth from outside through the connecting projections 98, 98. When the connecting projection 98 is positioned in the first groove 102, the percussion switching lever 93 is at a backward position. On the other hand, when the connecting projection 98 is positioned at the summit of the trapezoidal second groove 103, the percussion switching lever 93 is at a forward position.

In this embodiment, the switching case 64 is made of synthetic resin. Therefore, stainless steel plates 104, 104 are separately provided for a portion including the rear end of the second groove 103 on the guide plate 100 in order to improving strength of the percussion switching groove 101.

Next, rotative positions of the switching case 64 which can be changed by the operation of the switching button 30 and operation modes obtained with the same will be explained.

As shown in FIG. 11, when the switching button 30 is at a first position being located at the left end of the window 32 (In FIG. 8, it is the upper side. Hereinafter, the direction of anvil 8 is the front side.), the switching case 64 is at a first rotative position. With this position, in the clutch switching groove 65, the connecting projection 62 of the clutch switching lever 57 is positioned at the right end of a fist groove 66. Consequently, the clutch switching lever 57 is located at the forward position to regulate the rotation of the second internal gear 16. In the impact switching groove 84, the stepped pin 83 is located at the left end of the first groove 85. Thus, the auxiliary ring 78 is at a forward position and engages with the arm 76. Moreover, in the percussion switching groove 101, the connecting projection 98 is located at the right end of the first groove 102. Thus, the percussion switching lever 93 is at a backward position and separate from the second cam 90.

Therefore, the second internal gear 16 is directly prevented from idling by the clutch switching lever 57, so that a drill mode is selected in which the anvil 8 rotates integrally with the spindle 18 through the auxiliary ring 78. Here, the second cam 90 is freely rotatable, so that the percussion does not occur even if the second cam 90 abuts to the first cam 87.

Figure 12A:
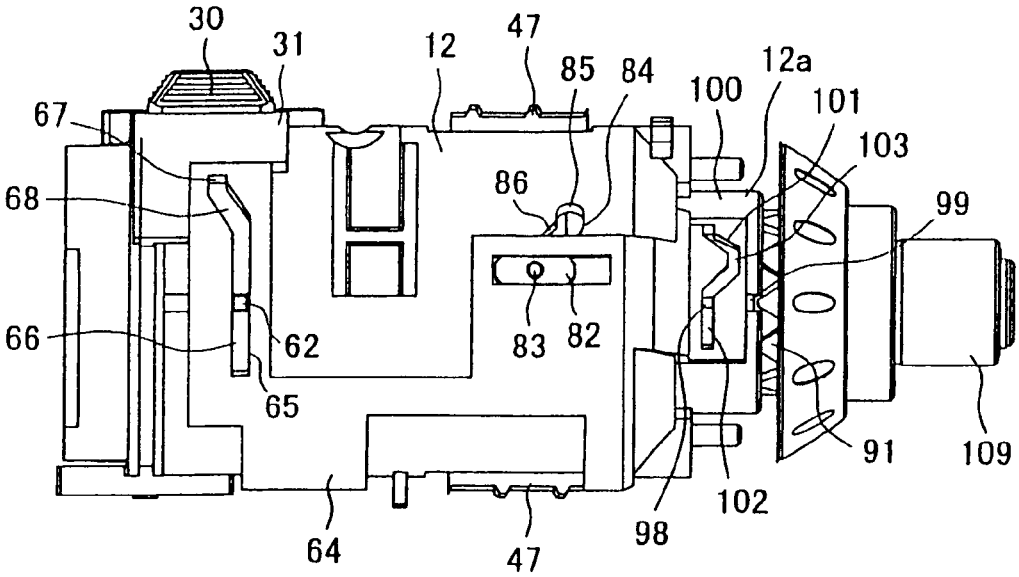
FIG. 12A shows a lateral view of a gear case portion in the impact mode.
Figure 12B:
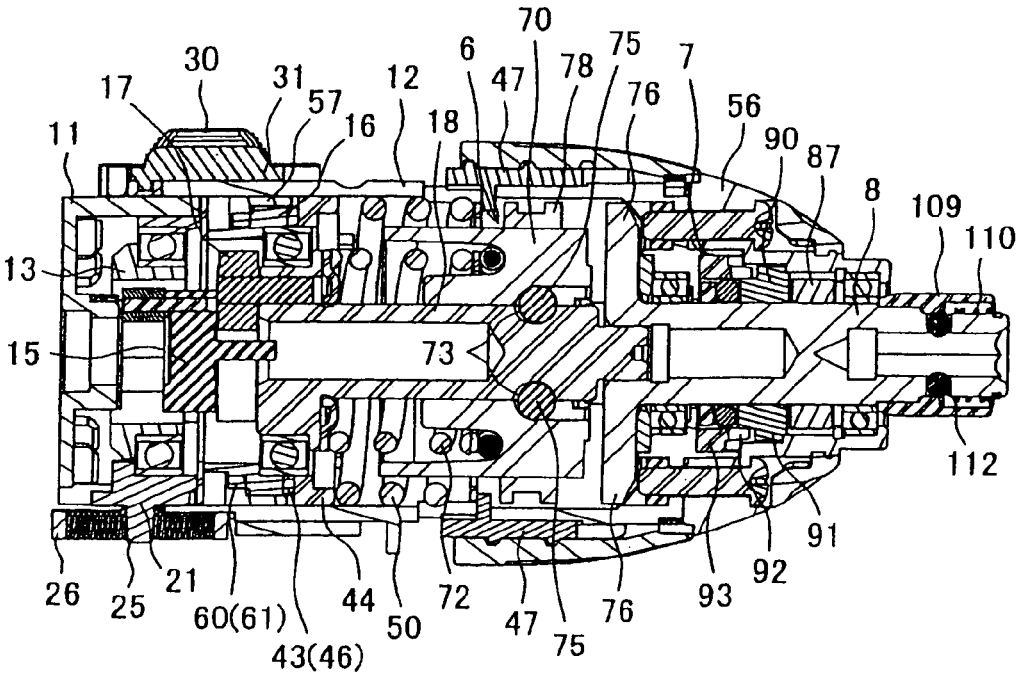
FIG. 12B shows a vertical section view of a gear case portion in the impact mode (a change ring and the hammer case are also shown).

Next, as shown in FIG. 12, when the switching button 30 is moved to the right from the first position by approximately one-third of the transverse length of the window 32, the switching case 64 is at a second rotative position. With this position, in the clutch switching groove 65 and the percussion switching groove 101, the forward position of the clutch switching lever 57 and the backward position of the percussion switching lever 93 are maintained because the connecting projections 62, 98 are still within the first grooves 66, 102. However, in the impact switching groove 84, the stepped pin 83 is inserted into the second groove 86 and moved to the summit of the V-groove. Therefore, the auxiliary ring 78 moves backward and is separated from the arm 76.

Therefore, at a second position of the switching button 30, an impact mode is selected in which no percussion occurs, because the second internal gear 16 is prevented from idling regardless of a load on the anvil 8 and the second cam 90 is freely rotatable while the spindle 18 and the anvil 8 are connected through the hammer 70.

Figure 13A:
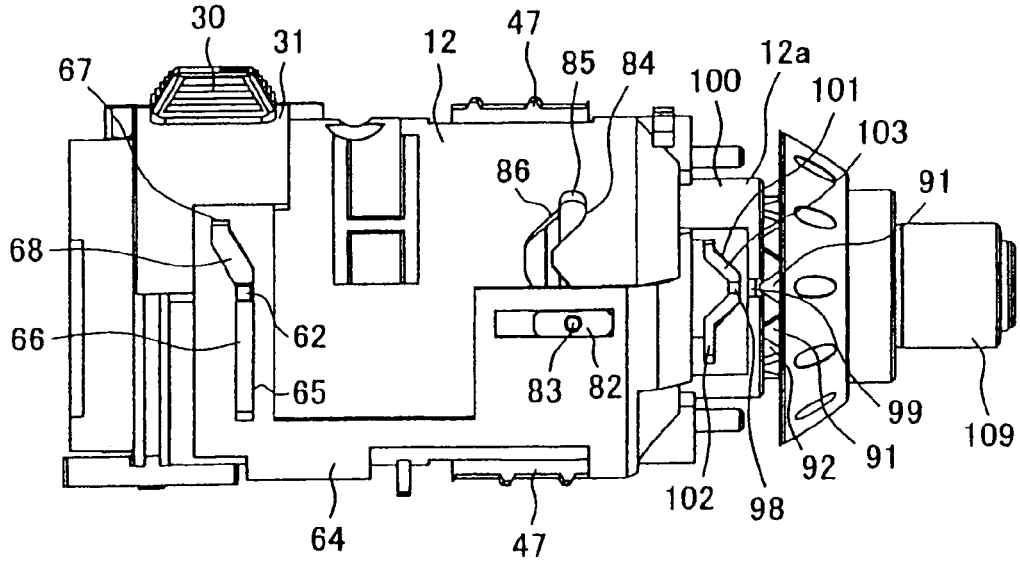
FIG. 13A shows a lateral view of a gear case portion in a percussion drill mode.
Figure 13B:
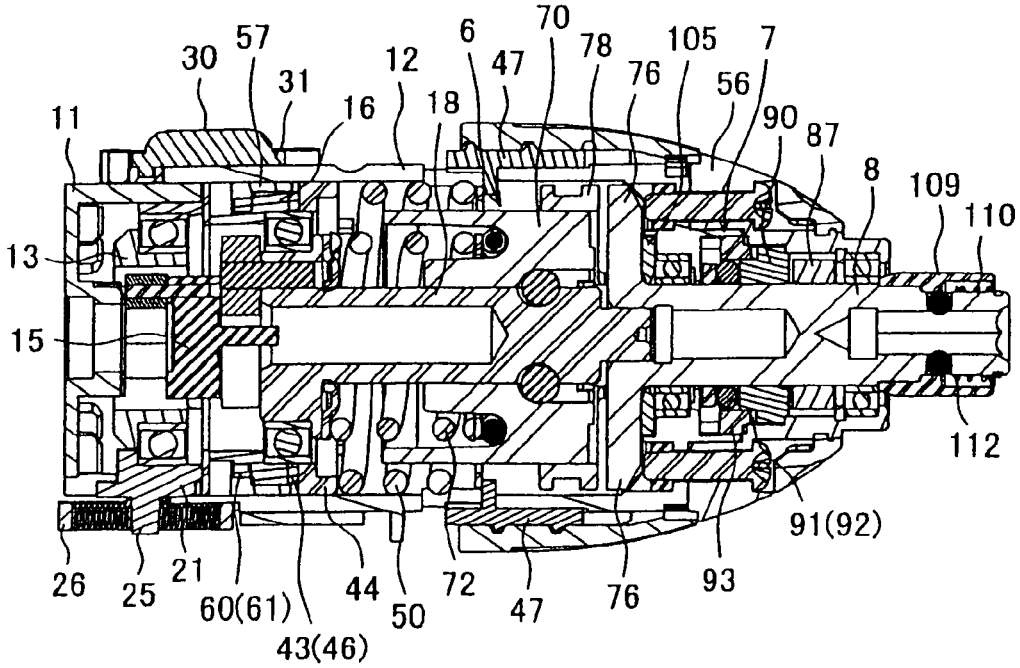
FIG. 13B shows a vertical section view of a gear case portion in a percussion drill mode (a change ring and the hammer case are also shown).

Next, as shown in FIG. 13, when the switching button 30 is moved to the right from the second position by approximately one-third of the transverse length of the window 32, the switching case 64 is at a third rotative position. With this position, in the clutch switching groove 65 the connecting projection 62 is still in the first groove 66. However, in the impact switching groove 84, the stepped pin 83 is inserted into the first groove 85 again to move the auxiliary ring 78 to the forward position. Moreover, in the percussion switching groove 101, the connecting projection 98 is inserted into the second groove 103 to move to the summit of the trapezoidal shape. Therefore, the percussion switching lever 93 moves forward to regulate the rotation of the second cam 90.

Consequently, at a third position of the switching button 30, the second internal gear 16 is prevented from idling irrespective of the load on the anvil 8, and the anvil 8 rotates integrally with the spindle 18. The anvil 8 is accommodated so as to be slightly movable back and forth between a forward position where the front ends of the arms 76, 76 abut to a nylon washer 105 which is held by the small cylindrical portion 12*a* of the gear case 12 and which is externally provided at the anvil 8, and a backward position where the rear ends of the arms 76, 76 abut to a step portion at the front end of the spindle 18. Because of this, at the backward position of the anvil 8, a percussion drill mode is selected in which the first cam 87 rotating with the anvil 8 abuts to the second cam 90 regulated its rotation by the percussion switching lever 93.

Figure 14A:
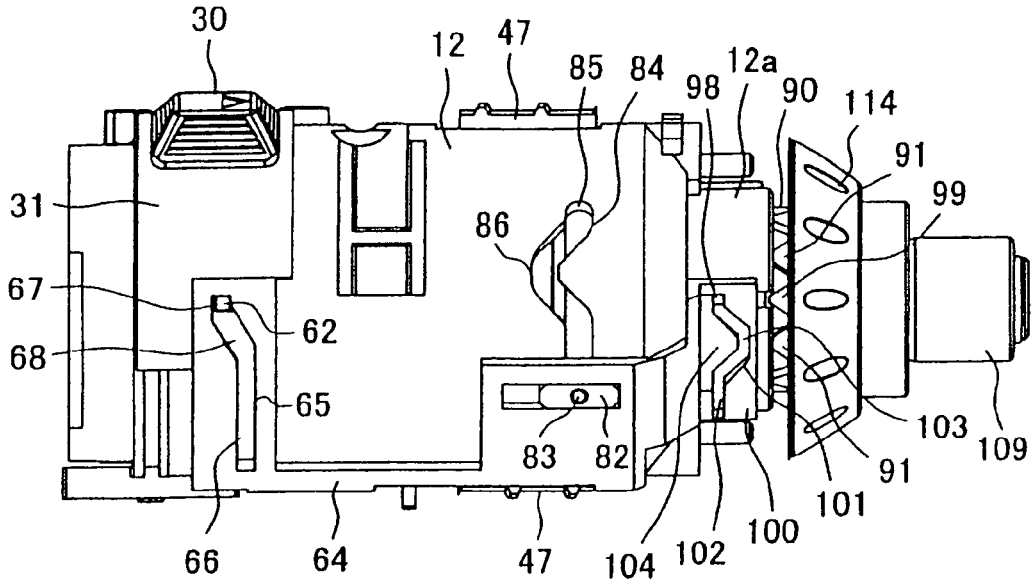
FIG. 14A shows a lateral view of a gear case portion in a clutch mode.
Figure 14B:
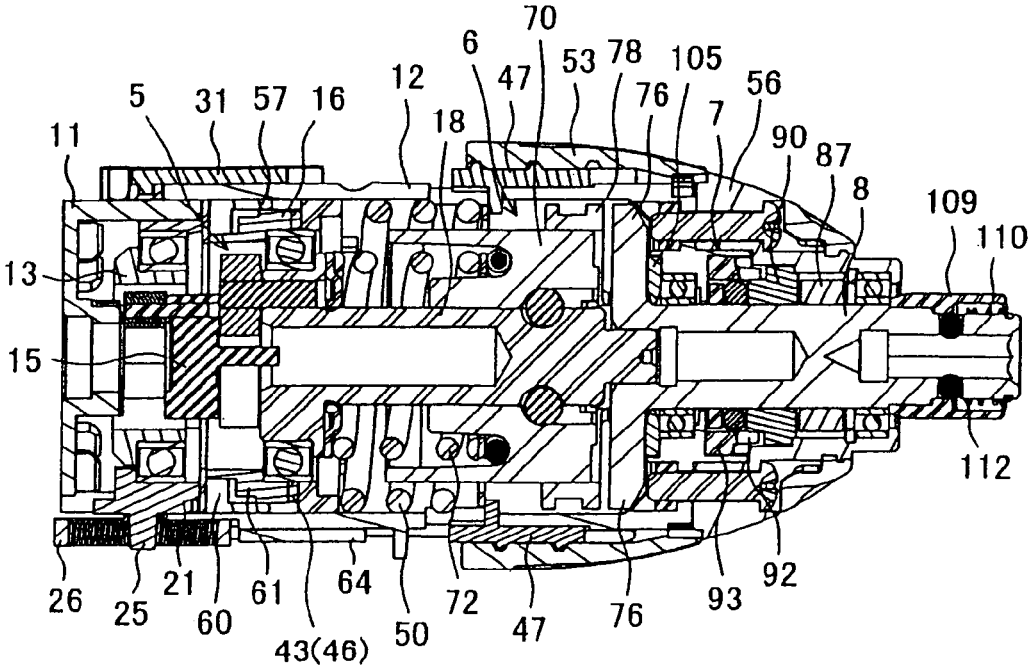
FIG. 14B shows a vertical section view of a gear case portion in a clutch mode (a change ring and the hammer case are also shown).

As shown in FIG. 14, when the switching button 30 is located at the right end of the window 32, the switching case 64 is at a fourth rotative position. With this position, in the clutch switching groove 65, the connecting projection 62 is moved into the second groove 67 guided by the inclined groove 68 to move the clutch switching lever 57 backward. In the impact switching groove 84, as the stepped pin 83 is located at the right end of the first groove 85, the auxiliary ring 78 is still remained at the forward position. However, in the percussion switching groove 101, the connecting projection 98 is moved backward again from the second groove 103 and moves to the left end of the first groove 102. Therefore, the percussion switching lever 93 moves backward to disengage from the second cam 90.

Consequently, at a fourth position of the switching button 30, no impact occurs since the anvil 8 rotates integrally with the spindle 18 and no percussion occurs since the second cam 90 is freely rotatable. With this position, a clutch mode is selected where the second internal gear 16 is locked only by the biasing force of the coil spring 50 because the clutch switching lever 57 is moved backward.

As shown in FIGS. 7 and 10A, the switching button 30 accommodates a steel ball 106 with a coil spring 107 pressing the steel ball 106 to the inner surface of the switching plate 31. On the outer surface of the gear case 12, concave portions 108, 108 . . . corresponding to four slide positions of the switching button 30 is provided aligning back and forth in two rows. With this structure, when the switching button 30 is slid, clicking operation in accordance with each operation mode and speed switching position can be obtained.

On the other hand, at the front outer circumference of the anvil 8, a chuck sleeve 109 is provided so as to be movable back and forth in the axial direction. The chuck sleeve 109 is pressed to a backward position where it abuts to the inner ring of the ball bearing 69 provided at the front by a coil spring 110 externally provided on the anvil 8 at the front of the chuck sleeve 109. At the backward position, a projection 111 provided at the inner circumference of the chuck sleeve 109 presses balls 112, 112, which are inserted so as to be radially movable in the anvil 8, toward the center of axle. Then the balls 112, 112 are made to protrude into an attaching hole 113 provided at the center of axle of the anvil 8 and having a hexagonal section so as to receive and fix a bit (not shown) to be inserted into the attaching hole 113. When the chuck sleeve 109 is slid forward against the biasing force of the coil spring 110, the pressing of the balls 112 by the projection 111 is released, whereby the bit can be attached to or detached from the attaching hole 113.

In particular, as the chuck sleeve 109 pressed backward abuts to the ball bearing 69, in a normal state the anvil 8 is at a forward position biased by a coil spring 110 to maintain a state in which the first cam 87 and the second cam 90 do not contact with each other. When the bit attached to the anvil 8 is pushed on the head of a screw etc., the anvil 8 is moved backward and the cam teeth 94 and 95 of the first and second cams 87, 90 contact each other.

In the above-structured impact driver 1, the drill mode as shown in FIG. 11 is selected by sliding the switching button 30 to the first position. In the drill mode, the trigger 10 is pressed to turn ON the switch 9, and the motor 3 is driven to rotate the motor shaft 4. The rotation speed of the motor shaft 4 is reduced through the planetary gear reduction mechanism 5 and transferred to the spindle 18. The spindle 18 is connected to the anvil 8 by not only the hammer 70 but also the auxiliary ring 78 positioned at a forward position. Because of this, the anvil 8 always rotates with the spindle 18, resulting that impact does not occur in the impact mechanism 6. In the percussion mechanism 7, since the percussion switching lever 93 is free, percussion does not occur even when the anvil 8 is moved backward. Therefore, boring can be conducted using a drill bit and the like attached to the anvil 8. In this case, the second internal gear 16 is regulated its rotation by the clutch switching lever 57, so that the clutch mechanism is stopped, that is, the anvil 8 continues to rotate irrespective of a load on the same.

When the switching button 30 is slid to the second position, the impact mode is selected as shown in FIG. 12. In the impact mode, the switch 9 is turned ON and rotation of the spindle 18 is transferred to the anvil 8 through the hammer 70. Then, screwing with the driver bit attached on the anvil is performed. When the screwing proceeds to a state in which a load on the anvil 8 increases, the steel balls 75, 75 are rolled backward along the cam grooves 73, 73 of the spindle 18. Consequently, the hammer 70 is moved backward against the biasing force of the coil spring 72 until it disengages from the arms 76, 76 of the anvil 8. However, at the moment when the engaging portions 77, 77 disengage from the arms 76, 76, the hammer 70, which is rotating with the spindle 18, immediately moves forward again being pressed by the coil spring 72 until the engaging portions 77, 77 engage with the arms 76, 76. These disengagement and reengagement of the hammer 70 with respect to the anvil 8 are mechanically repeated, which leads to the intermittent impact operation to the anvil 8. In this way, tight screwing can be conducted. Similar to the drill mode, percussion does not occur in the percussion mechanism 7 and the clutch mechanism is stopped because the second internal gear 16 is locked.

Next, when the switching button 30 is slid to the third position, the percussion drill mode as shown in FIG. 13 is selected. In the percussion drill mode, when the switch 9 is turned ON, the hammer 70 and the anvil 8 are connected by the auxiliary ring 78. Consequently, the impact does not occur in the impact mechanism 6 and the clutch mechanism is stopped because the second internal gear 16 is locked. However, in the percussion mechanism 7, the rotation of the second cam 90 is regulated by the percussion switching lever 93. Because of this, when the anvil 8 is moved backward by being pressed by the drill bit and the like, the first cam 87 rotating integrally with the anvil 8 abuts to the second cam 90. As a result, the percussion in the axial direction occurs to the anvil 8 because the cam teeth 94, 95 interfere with each other.

Next, when the switching button 30 is slid to the fourth position, the clutch mode as shown in FIG. 14 is selected. In the clutch mode, when the switch 9 is turned ON, the connecting status between the hammer 70 and the anvil 8 through the auxiliary ring 78 is still maintained, so that the impact does not occur in the impact mechanism 6. In the percussion mechanism 7, since the second cam 90 is freely rotatable, percussion does not occur even when the anvil 8 is moved backward. However, in the planetary gear reduction mechanism 5, the rotation of the second internal gear 16 which is regulated by the clutch switching lever 57 is released. With this mechanism, when screwing proceeds to the state in which a load on the anvil 8 and the spindle 18 exceeds the pressing by the coil spring 50, the engaging projection 43 of the second internal gear 16 pushes the pressing ring 44 forward until the engaging projection 43 and the engaging projection 46 pass each other. As a result, the second internal gear 16 idles, thereby ending screwing. The clutch operation torque can be adjusted by changing the contraction status of the coil spring 50 in accordance with rotative operation of the change ring 53.

In each operation mode mentioned above, the switching plate 31 is usually slid to right and left at a forward position guided by the switching button 30 in the window 32. Consequently, the first internal gear 13 together with the speed switching ring 21 is freely rotatable at a forward position, whereby the anvil 8 rotates in a high speed mode in which the planetary gear 14 and the carrier 15 are connected.

Further, the switching button 30 can be moved backward only at the first position. In this case, the internal gear 13 together with the speed switching ring 21 is moved backward to be regulated its rotation, whereby it engages with only the planetary gear 14. Therefore, the anvil 8 rotates in a slow mode. In this way, switching of high speed/slow rotation of the anvil 8 can be conducted only in the drill mode.

Similarly to the first embodiment, in the impact driver 1 in accordance with the second embodiment, both boring and screwing can be conducted only with the impact driver, whereby improvement of its operability can be expected. In particular, the impact driver has a simple structure in which the connection status between the hammer 70 and the anvil 8 is switched using the auxiliary ring 78. Therefore, a drill mode is obtained without fail and enlargement of the hammer case 56 is prevented, and the drill mode is feasible with a low cost. Moreover, when the hammer 70 engages with the anvil 8 through the auxiliary ring 78 in the impact mode, the hammer 70 which is connected with the auxiliary ring 78 engages with the anvil 8, whereby the mass of the hammer 70 itself which moves back and forth can be set to be smaller. As a result, vibration can be reduced in the impact mode, thereby maintaining excellent operability.

Moreover, the connecting member is formed as the auxiliary ring 78 externally provided with the hammer 70 so as to be rotatable integrally as well as movable in the axial direction and having the auxiliary engaging portions 79, 79 for being attached to the engaging portions 77, 77 provided with the hammer 70. With this structure, at the first slide position the auxiliary ring 78 disengages from the anvil 8 to rotate integrally with the hammer 70 only, at the second slide position it is made to engage with the arms 76, 76 of the anvil 8, so that the hammer 70 and the anvil 8 rotate integrally with each other. In this way, the connecting member can be simply formed and it can engage with or disengage from the anvil 8 smoothly, thereby obtaining excellent operability.

It should be noted that the engagement between a hammer and a ring member is not limited to a pair of chamfered surfaces as shown in the second embodiment. It is acceptable to adopt another engagement, for example, the hammer is splined to the ring member or they are connected using a key. Moreover, the number or the shape of a second engaging portion may be changed in accordance with that of an engaging portion of the hammer. Further, the ring member itself may be longer in the axial direction.

In addition, an operating means for the ring member is not limited to the means shown in the above embodiments. For example, the structure including only a guide groove and an axis member as described in the first embodiment is acceptable if the percussion drill mode and the clutch mode are unnecessary.

In the second embodiment, an impact driver is described in which selection among four operation modes can be conducted, which are, the drill mode, the impact mode, the percussion drill mode and the clutch mode. However, all the four operation modes are not necessary, and thus a percussion mechanism and a clutch mechanism may be omitted in an impact driver according to the present invention, as long as the impact mode and the drill mode can be selected.

What is claimed is:

1. An impact driver comprising:

a motor housed in a housing;

a spindle driven by the motor to rotate;

an anvil protruding forward and supported in the housing so as to be rotatable, and a hammer provided with the spindle at the rear of the anvil for engaging with the anvil and transferring rotation of the spindle to the anvil, wherein the hammer engages with or disengages from the anvil in accordance with a torque load on the anvil, which leads to intermittent impact operation to the anvil in the rotative direction, wherein the impact driver further comprises a connecting member provided in the housing so as to be movable between a first slide position where engagement of the connecting member with only one of the hammer and the anvil is achieved in order for the connecting member to rotate integrally with one of the hammer and the anvil, and a second slide position where engagement with both the hammer and the anvil is achieved in order for the connecting member to rotate integrally with both of the hammer and the anvil, and an operating means provided in the housing for moving the connecting member to the first or second slide position from outside of the housing, and wherein an impact mode where the impact operation occurs to the anvil is obtained when the first slide position of the connecting member is selected by the operating means, and a drill mode where the impact operation is stopped irrespective of a load on the anvil is obtained when the second slide position of the connecting member is selected.

2. An impact driver in accordance with claim 1, wherein engagement of the anvil and the hammer is achieved by a pair of arms extending in the radial direction at the rear end of the anvil and a pair of engaging portions provided at the front surface of the hammer.

3. An impact driver in accordance with claim 2, wherein engaging teeth are formed at the outer circumference of the anvil and the hammer, and the connecting member is formed as a sleeve having a larger diameter than the hammer and the anvil and provided with connecting teeth in its inner circumference for engaging with the engaging teeth, and the sleeve is slid in the axial direction to move to the first slide position and the second slide position.

4. An impact driver in accordance with claim 3, wherein the operating means is an axis member which is inserted into a concave groove provided at the outer circumference of the sleeve through a guide groove formed in the housing and which guides the sleeve to the slide positions through movement in the guide groove.

5. An impact driver in accordance with claim 4, wherein the axis member has a slide plate provided integrally for sliding on the outer circumference of the housing in accordance with the operation of the axis member so as to close off the outside of the guide groove.

6. An impact driver in accordance with claim 2, wherein the connecting member is a ring member externally provided on the hammer so as to be rotatable integrally as well as movable in the axial direction, and having a second engaging portion being attached to an engaging portion provided with the hammer for engaging with the anvil, and wherein at a backward first slide position the ring member is separated from the anvil, and at a forward second slide position the second engaging portion engages with the anvil.

7. An impact driver in accordance with claim 6, wherein the ring member is externally provided on the hammer by engagement of a pair of chamfered surfaces provided at the outer circumference of the hammer and the inner circumference of the ring member respectively.

8. An impact driver in accordance with claim 7, wherein the operating means comprises a switching groove formed in a curved line in the circumferential direction in an inner case fixed within the housing, a linear slit formed in the longitudinal direction on a switching case externally provided on the inner case so as to be rotatable at the outside of the inner case, a pin member penetrating through the switching groove as well as the slit so as to engage with the ring member and a switching plate having a button on its surface for operating rotation of the switching case from outside of the housing, wherein in accordance with rotation of the switching case operated by the switching plate, the ring member is moved to the slide positions by moving the pin member in the slit back and forth guided by the switching groove.

9. An impact driver in accordance with claim 8, wherein the pin member has a dual structure consisting of a center pin and a cylindrical body externally provided on the center pin for contacting with the inner surface of the switching groove.

10. An impact driver in accordance with claim 4, wherein the guide groove is formed into an L-shape consisting of a first groove provided in the circumferential direction of the housing and a second groove extending sequentially from the end of the first groove in the longitudinal direction, and wherein the first slide position of the sleeve is selected when the axis member is positioned in the first groove, and the second slide position of the sleeve is selected when the axis member is positioned in the front end of the second groove.

11. An impact driver in accordance with claim 10, wherein a biasing means for pressing the axis member with the sleeve to the front end side of the second groove is provided.

12. An impact driver in accordance with claim 1, wherein engaging teeth are formed at the outer circumference of the anvil and the hammer, and the connecting member is formed as a sleeve having a larger diameter than the hammer and the anvil and provided with connecting teeth in its inner circumference for engaging with the engaging teeth, and the sleeve is slid in the axial direction to move to the first slide position and the second slide position.

13. An impact driver in accordance with claim 12, wherein the operating means is an axis member which is inserted into a concave groove provided at the outer circumference of the sleeve through a guide groove formed in the housing and which guides the sleeve to the slide positions through movement in the guide groove.

14. An impact driver in accordance with claim 13, wherein the axis member has a slide plate provided integrally for sliding on the outer circumference of the housing in accordance with the operation of the axis member so as to close off the outside of the guide groove.

15. An impact driver in accordance with claim 13, wherein the guide groove is formed into an L-shape consisting of a first groove provided in the circumferential direction of the housing and a second groove extending sequentially from the end of the first groove in the longitudinal direction, and wherein the first slide position of the sleeve is selected when the axis member is positioned in the first groove, and the second slide position of the sleeve is selected when the axis member is positioned in the front end of the second groove.

16. An impact driver in accordance with claim 15, wherein a biasing means for pressing the axis member with the sleeve to the front end side of the second groove is provided.

17. An impact driver in accordance with claim 1, wherein the connecting member is a ring member externally provided on the hammer so as to be rotatable integrally as well as movable in the axial direction, and having a second engaging portion being attached to an engaging portion provided with the hammer for engaging with the anvil, and wherein at a backward first slide position the ring member is separated from the anvil, and at a forward second slide position the second engaging portion engages with the anvil.

18. An impact driver in accordance with claim 17, wherein the ring member is externally provided on the hammer by engagement of a pair of chamfered surfaces provided at the outer circumference of the hammer and the inner circumference of the ring member respectively.

19. An impact driver in accordance with claim 17, wherein the operating means comprises a switching groove formed in a curved line in the circumferential direction in an inner case fixed within the housing, a linear slit formed in the longitudinal direction on a switching case externally provided on the inner case so as to be rotatable at the outside of the inner case, a pin member penetrating through the switching groove as well as the slit so as to engage with the ring member and a switching plate having a button on its surface for operating rotation of the switching case from outside of the housing, wherein in accordance with rotation of the switching case operated by the switching plate, the ring member is moved to the slide positions by moving the pin member in the slit back and forth guided by the switching groove.

20. An impact driver in accordance with claim 19, wherein the pin member has a dual structure consisting of a center pin and a cylindrical body externally provided on the center pin for contacting with the inner surface of the switching groove.

* * * * *